US010760357B2

(12) United States Patent
Tan et al.

(10) Patent No.: US 10,760,357 B2
(45) Date of Patent: Sep. 1, 2020

(54) TRIPLE ACTIVITY SYSTEM AND METHOD FOR DRILLING OPERATIONS

(71) Applicant: Keppel Offshore & Marine Technology Centre Pte Ltd, Singapore (SG)

(72) Inventors: Boon Lee Tan, Singapore (SG); Anis Altaf Hussain, Singapore (SG); Aziz Amirali Merchant, Singapore (SG); Leng Yeow Ong, Singapore (SG); Boon Seng Lim, Singapore (SG); Yizhe Lester Phong, Singapore (SG)

(73) Assignee: KEPPEL OFFSHORE & MARINE TECHNOLOGY CENTRE PTE LTD, Singapore (SG)

( * ) Notice: Subject to any disclaimer, the term of this patent is extended or adjusted under 35 U.S.C. 154(b) by 0 days.

(21) Appl. No.: 16/528,599

(22) Filed: Jul. 31, 2019

(65) Prior Publication Data

US 2019/0352981 A1 Nov. 21, 2019

Related U.S. Application Data

(63) Continuation of application No. 14/782,546, filed as application No. PCT/SG2014/000152 on Apr. 4, 2014, now abandoned.

(30) Foreign Application Priority Data

Apr. 5, 2013 (SG) ..... 201302600

(51) Int. Cl.
*E21B 19/00* (2006.01)
*E21B 19/14* (2006.01)
(Continued)

(52) U.S. Cl.
CPC ..... *E21B 19/143* (2013.01); *B63B 35/4413* (2013.01); *E21B 15/003* (2013.01);
(Continued)

(58) Field of Classification Search
CPC combination set(s) only.
See application file for complete search history.

(56) References Cited

U.S. PATENT DOCUMENTS 4,086,971 A 5/1978 Hall et al.
4,156,577 A 5/1979 McMakin
(Continued)

FOREIGN PATENT DOCUMENTS

CN 201559801 8/2010
WO 2014186889 11/2014

OTHER PUBLICATIONS

Hall, J.E., et al., "Use of the Dual-Activity Drillship as a Field Development Tool", Offshore Technology Conference, Jan. 1, 1999 (Jan. 1, 1999), pp. 3-6.XP055313597, DOI:10.4043/10891-MS.
(Continued)

*Primary Examiner* — Sean D Andrish
(74) *Attorney, Agent, or Firm* — BakerHostetler

(57) ABSTRACT

Systems and methods related to a drilling rig or a drill ship having a first activity center with a main well, a second activity center with an auxiliary well and a third activity center with offline casing with drill pipe stand-building capabilities. The offline casing and drill stand-building facility is a standalone feature and can be located in the forward or aft side of a drilling rig or drill ship depending on the choice of the builder or operator.

6 Claims, 10 Drawing Sheets

(51) Int. Cl.

| | |
|---|---|
| ***E21B 15/02*** | (2006.01) |
| ***B63B 35/44*** | (2006.01) |
| ***E21B 19/16*** | (2006.01) |
| ***E21B 15/00*** | (2006.01) |

(52) U.S. Cl.
CPC ..... *E21B 15/02* (2013.01); *E21B 19/002* (2013.01); *E21B 19/14* (2013.01); *E21B 19/16* (2013.01)

(56) References Cited

U.S. PATENT DOCUMENTS

| | | | |
|---|---|---|---|
| 5,379,844 | A | 1/1995 | Glasscock et al. |
| 6,085,851 | A | 7/2000 | Scott et al. |
| 7,802,636 | B2 | 9/2010 | Childers et al. |
| 2010/0012376 | A1 | 1/2010 | Bagassi |
| 2012/0067642 | A1 | 3/2012 | Magnuson |
| 2016/0053558 | A1 | 2/2016 | Tan et al. |

OTHER PUBLICATIONS

Stegeman, S., et al., "How the dual activity drillfloor is expected to operate", Integrating handling systems and work flow, Apr. 1, 1999, (Apr. 1, 1999). XP055313593. Retrieved from the Internet: URL: http:://www.offshoremag.com/articles/print/volume59/issue/departments/drilling-productionjhow-the-dual-activity-drillfloor-is-expected-to-operate.html.

International Search Report and Written Opinion for International Application PCT/SG2014/000152, Report Completed Jun. 4, 2014, dated Jun. 4, 2014, 10 Pgs.

International Preliminary Report on Patentability for International Application PCT/SG2014/000152, Report Completed Jun. 4, 2014, 10 Pgs.

Chinese Office Action dated Sep. 29, 2016, from related application Chinese Patent Application No. CN 201480019307.4, 20 pgs.

Extended European Search Report for European Application No. 14778940.8, Search Completed Oct. 25, 2016, dated Nov. 3, 2016, 10 Pgs.

Office Action 1 for U.S. Appl. No. 14/782,546, dated Jun. 14, 2017, 13 pp.

Response to Office Action 1 for U.S. Appl. No. 14/782,546, dated Sep. 14, 2017, 24 pp.

Final Office Action 1 for U.S. Appl. No. 14/782,546, dated Sep. 27, 2017, 11 pp.

Response to Final Office Action 1 for U.S. Appl. No. 14/782,546, dated Dec. 26, 2017, 59 pp.

Second Response to Final Office Action 1 for U.S. Appl. No. 14/782,546, dated Feb. 27, 2018, 62 pp.

Office Action 3 for U.S. Appl. No. 14/782,546, dated Mar. 14, 2018, 9 pp.

Response to Office Action 3 for U.S. Appl. No. 14/782,546, dated Jun. 13, 2018, 11 pp.

Final Office Action 2 for U.S. Appl. No. 14/782,546, dated Jul. 16, 2018, 10 pp.

Response to Final Office Action 2 for U.S. Appl. No. 14/782,546, dated Oct. 16, 2018, 14 pp.

Office Action 5 for U.S. Appl. No. 141782,546, dated Oct. 24, 2018, 8 pp.

Appeal Brief for U.S. Appl. No. 14/782,546, dated Apr. 22, 2019, 16 pp.

TRIPLE ACTIVITY SYSTEM AND METHOD FOR DRILLING OPERATIONS

CROSS-REFERENCE TO RELATED TO APPLICATIONS

This application is a continuation of U.S. patent application Ser. No. 14/782,546, filed Oct. 5, 2015 that is a national stage filing of PCT Application PCT/SG2014/000152 filed Apr. 4, 2014 that claims priority to Singapore Patent Application 201302600-0 filed Apr. 5, 2013, all of which are expressly incorporated herein by reference in their entirety as if set forth herewith.

FIELD OF THE INVENTION

This invention relates to a drillship or a drilling rig having a drill-floor with three activity centers. The first activity center includes a main well, the second activity center includes an auxiliary well and the third activity center includes an offline casing and drill pipe stand-building facility. The offline casing and drill pipe stand-building facility is a standalone feature and can be located in the forward or aft side of a drillship or a drilling rig depending on the choice of the builder or operator.

PRIOR ART

The drilling depths at deep water drill sites easily double or triple as these drill sites move further away from land masses. At such sites, drilling efficiency is of paramount concern as the operating costs at such drill sites depend on the amount of time it takes to complete a drilling operation.

A typical drilling operation involves the handling and/or assembly of drill pipes, risers and casings received from a travelling shuttle on an elevated platform leading to the drill floor. The drill pipes will be connected together through stand building operations to form vertical drill strings. The individual drill pipes, risers and casings for the well drilling process are retrieved from a storage location and horizontally transported to the derrick via shuttles for subsequent stand-building, racking or hoisting. The rig or ship designs that adopt a dual hoisting generally have two well center s on a drill floor and each well center usually uses their own tubular feeding system for each well center. The making up operations or stand building operations of drill strings and casings are thus limited by having only one feeder platform on each side at the aft and forward catwalk platforms. Further, drilling activities at the auxiliary well will have to be stopped to allow for the making up operations or drilling pipes or casings. This is inefficient as it increases the amount of time required to complete a drilling operation.

SUMMARY OF INVENTION

The above and other problems in the art are solved and an advance in the art is made in accordance with this invention. In accordance with a first aspect of the invention, in order to optimize stand-building capabilities, a stand-building facility for drill pipes and casings can be introduced in order to carry out offline make up or break out operations while the other two well center s are occupied by various other drilling activities. Such an arrangement will enable three activities to be simultaneously conducted independent of each other at three separate locations. These three locations are at the first activity center, the second activity center and the third activity center. In accordance with a second aspect of the invention, horizontally travelling platforms are provided to each of the activity center s thereby allowing pipes, risers or casings to be continuously and smoothly supplied to each of these activity center s.

The above and other problems in the art are solved and an advance in the art is made in accordance with this invention. In accordance with embodiments of the invention, there is provided a triple activity system at a drill floor on a drillship for conducting drilling operations on a seabed beneath the drillship comprising a first activity center having a main well and a first top drive assembly for advancing tubular members through the main well to the seabed, a second activity center having an auxiliary well and a second top drive assembly for advancing tubular members through the auxiliary well to the seabed and a third activity center having a receptacle for receiving an upright tubular member and an iron roughneck for making modifications to tubular member assemblages wherein the modifications to tubular member assemblages may be carried out when main drilling activities are conducted at the first activity center or when auxiliary drilling activities are conducted at the second activity center. The system also has a storage area positioned adjacent the third activity center for receiving and storing modified tubular member assemblages and tubular members from the third activity center. Further, a first delivery assembly is positioned adjacent the storage area, the first activity center, the second activity center and the third activity center for transferring tubular member assemblages or tubular members between the storage area, the first activity center, the second activity center or the third activity center.

In accordance with embodiments of the invention, the first delivery assembly of the triple activity system includes a pipe handling unit that is configured to transfer the tubular member assemblages or the tubular members between a fingerboard rack in the storage area and the second top drive assembly in the second activity center or the first top drive assembly in the first activity center. In embodiments of the invention, the pipe handling unit is further configured to transfer tubular members or tubular member assemblages between the third activity center and the storage area.

In accordance with embodiments of the invention, the triple activity system further includes a second delivery assembly positioned adjacent the first activity center and the second activity center for transferring tubular members or tubular member assemblages between the first activity center and the second activity center to facilitate concurrent drilling operations. In accordance with other embodiments of the invention, the second delivery assembly of the triple activity system includes a pipe handling unit configured to transfer the tubular member assemblages or the tubular members between the first top drive assembly in the first activity center and the second top drive assembly in the second activity center.

In accordance with embodiments of the invention, the triple activity system further includes a first traveling platform provided between the first activity center and a first tubular member storage bay. This first traveling platform is configured to receive tubular members from the first tubular member storage bay and is configured to transfer the received tubular members to the first top drive assembly.

In accordance with embodiments of the invention, the triple activity system further comprises a second traveling platform provided between the second activity center and a second tubular member storage bay. The second traveling platform is configured to receive tubular members from the second tubular member storage bay and is configured to transfer the received tubular members to the second top drive assembly.

In accordance with embodiments of the invention, the triple activity system further includes a third traveling platform provided between the third activity center and a third tubular member storage bay. The third traveling platform is configured to receive tubular members from the third tubular member storage bay and is configured to transfer the received tubular members to the iron roughneck.

BRIEF DESCRIPTION OF THE DRAWINGS

The above advantages and features of a system in accordance with this invention are described in the following detailed description and are shown in the drawings.

DETAILED DESCRIPTION

This invention relates to a drillship or a drilling rig having three activity centers at the drill floor of the drillship or drilling rig. The first activity center has a main well, the second activity center has an auxiliary well and the third activity center has an offline casing and drill pipe stand-building facility. The offline casing and drill pipe stand-building facility is a standalone feature and can be located in the forward or aft side of a drillship or a drilling rig depending on the choice of the builder or operator.

The stand-building facility for drill pipes and casings at the third activity center r is able to carry out offline make up or break out operations while the other two well center are occupied by various other drilling activities. Through the addition of such an activity center, this enables three activities to be simultaneously conducted at the drill floor, independent of each other at three separate locations thereby greatly reducing the amount of time required for drilling operations. Further, horizontally travelling platforms are provided at each of the activity centers to allow pipes, risers or casings to be continuously and smoothly supplied to each of these activity centers from their respective pipe storage bays.

Figure 1:
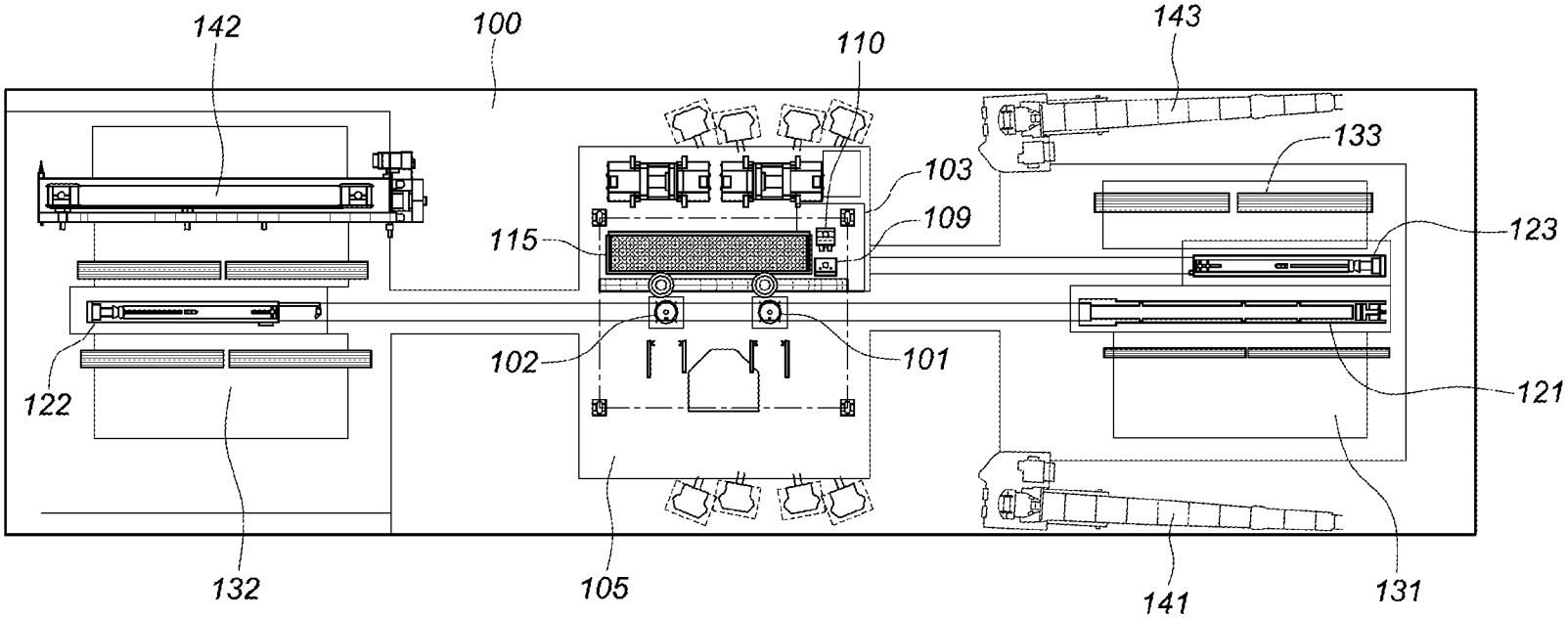
FIG. 1 illustrating a top view of a drillship having a triple activity system whereby the third activity center is provided at the forward side of the drillship in accordance with embodiments of the invention.

FIG. 1 illustrates a top view of drill rig or drillship 100 having drill floor 105 in accordance with embodiments of the invention. One skilled in the art will recognize that drill floor 105 may be provided on a drill rig, a drillship or any other such vessels that have sufficient space and are able to handle the weight of the various activity centers on the drill floor. As illustrated in FIG. 1, drill floor 105 comprises three activity centers. These are first activity center 101, second activity center 102 and third activity center 103. These three activity centers are all provided within the footprint of drill floor 105. In embodiments of the invention, individual derricks may be provided at each of the activity centers to facilitate the drilling activities being carried out at these activity centers. In order to reduce cost and the amount of space occupied on the deck of drillship 100, other embodiments of the invention provide that a single derrick sufficiently large and wide enough to encompass the drilling activities carried out at first activity center 101, second activity center 102 and third activity center 103 may be utilized in place of individual derricks at each activity center.

In embodiments of the invention, first activity center 101 may be provided with a main well that is configured to handle heavier tubular members such as risers while second activity center 102 may be provided with an auxiliary well that is configured to handle lighter tubular members or tubular member assemblies such as drill pipes, drill strings, or casings.

From hereafter, it shall be understood that the phrase tubular members refers to pipes, tubular conduits, conductors, casings, drill pipes and risers while tubular member assemblies/assemblages refer to tubular members that are joined together such as drill pipes that are joined together to from a long vertical drill string, casings that are joined together to form casing stands or pipes that are joined together to form pipe stands.

Conventional drilling activities conducted at first activity center 101 may include, but are not limited to, the advancement of tubular members or tubular assemblies through the main well, the running of tubular members or tubular assemblies through the main well, the withdrawal of tubular members or tubular assemblies through the main well, the lifting of tubular members or tubular assemblies through the main well, or the rotating of tubular members or tubular assemblies through the main well to the seabed. These activities may be carried out using a variety of devices including, but not limited to, top drive assemblies, sheaves, draw works, traveling blocks, rotary tables, hydraulic rams.

In embodiments of the invention, a top drive assembly may be utilized at first activity center 101 to provide rotational force to the tubular members that are being advanced through the main well. In other embodiments of the invention, a rotary table may be used in place of a top drive assembly to provide the required rotational force if so desired. The top drive assembly may be mounted on the derrick at first activity center 101. Tubular members or tubular member assemblies received by this top drive assembly are then advanced through the main well towards the seabed. Conversely, the top drive assembly may be used to withdraw the tubular members or tubular member assemblies from the seabed and through the main well onto the deck of drill ship 100 upon completion of drilling operations.

Similarly, auxiliary drilling activities that may be conducted at second activity center 102 may include, but are not limited to, the advancement of tubular members or tubular assemblies through the auxiliary well, the running of tubular members or tubular assemblies through the auxiliary well, the withdrawal of tubular members or tubular assemblies through the auxiliary well, the lifting of tubular members or tubular assemblies through the auxiliary well, or the rotating of tubular members or tubular assemblies through the auxiliary well to the seabed. These activities may be carried out using a variety of devices including, but not limited to, top drive assemblies, sheaves, draw works, traveling blocks, rotary tables, hydraulic rams.

In embodiments of the invention, a top drive assembly may be utilized at second activity center 102 to provide rotational force to the tubular members or tubular member assemblies that are being advanced through the auxiliary well. In other embodiments of the invention, a rotary table may be used in place of a top drive assembly to provide the required rotational force if so desired. The top drive assembly may be mounted on the derrick at second activity center 102. Tubular members or tubular member assemblies received by this top drive assembly are then advanced through the auxiliary well towards the seabed. Conversely, the top drive assembly may be used to withdraw the tubular members or tubular member assemblies from the seabed and through the auxiliary well onto the deck of drill ship 100 upon completion of drilling operations.

With the commencement of drilling operations at the drill site, tubular member assemblages would have to be assembled before the tubular member assemblages are advanced through the main well or auxiliary well at their respective activity centers. As first activity center 101 and second activity center 102 are focused on drilling operations that involve the advancement or withdrawal of tubular members or tubular member assemblies through their respective drilling wells, third activity center 103 is tasked with stand-building activities as concurrent drilling operations are carried out at the other two activity centers. These stand-building activities include the assembling of drill pipes to form longer drill strings or the assembling of casings, or conversely, the disassembling of drill strings or casings upon completion of the drilling operation. An iron roughneck is provided at third activity center 103 to assist in these stand-building activities.

Iron roughneck 110 provided at third activity center 103 may be used to make up or break out tubular member assemblies. Torque wrenches are utilized by iron roughneck 110 to make up or break down the tubular member assemblies. Receptacle 109 that is provided at third activity center 103 is also used to assist in the make up or break down operations. Receptacle 109 may be an offline mouse hole that may be used to receive and store an upright tubular member before the tubular member is assembled. In make up or break down operations, after a tubular member has been delivered to third activity center 103, the lower section of the tubular member will initially be placed in receptacle 109. When iron roughneck 110 is ready to receive the tubular member, iron roughneck 110 is brought towards the tubular member located within receptacle 109. Once iron roughneck 110 is adjacent the tubular member, iron roughneck 110 will clamp the lower section of the tubular member while the second tubular member is attached to the upper section of the clamped tubular member. A spinning or rotary wrench will be used by iron roughneck 110 to turn the top of the second tubular member thereby applying sufficient rotary torque to firmly affix the two tubular members together to form a tubular member assembly/assemblage.

The completed tubular member assembly may then be delivered to an adjacent storage area, such as storage area 115 for storage. The completed tubular member assembly may be delivered from third activity center 103 to storage area 115 using a delivery assembly provided adjacent third activity center 103, second activity center 102, first activity center 101 and storage area 115 such as a pipe handling unit. The pipe handling unit will have a wrench to grip the tubular member assembly. The gripped tubular member assembly will then be transferred from third activity center 103 to storage area 115. Storage area 115 may be provided with fingerboards, stand racks or pipe racks for receiving and storing the tubular member assemblies.

After a tubular member assembly has been broken down by iron roughneck 110 at triple activity center 103 into individual tubular members, the delivery assembly provided adjacent third activity center 103 and storage area 115 may be used to transport the individual tubular members from third activity center 103 to traveling platform 123 to be transported to storage bay 133 as described in greater detail below.

This delivery system may also be used to lift a tubular member assembly from the finger board or pipe racks at storage area 115 and subsequently deliver the gripped tubular member assembly to the second activity center 102. The tubular member assembly may then be fitted to the top drive assembly at the second activity center to be used for subsequent drilling operations. Once the drilling operations at second activity center 102 has been concluded, the delivery system may then transfer the used tubular member assembly back to storage area 115 for storage.

In embodiments of the invention, a further delivery system may also be provided adjacent first activity center 101 and second activity center 102 to transfer tubular members or tubular member assemblies between these two activity centers to facilitate concurrent drilling operations at these two centers.

Each of the activity centers are connected to a tubular member feeder system that delivers tubular members from their respective pipe storage bays to the respective activity systems. In embodiments of the invention, as illustrated in FIG. 1, traveling platform 121 is provided between storage bay 131 and first activity center 101. Traveling platform 121 comprises a shuttle for receiving tubular members and also includes a catwalk platform that runs between storage bay 131 and first activity center 101. The shuttle travels along the catwalk platform transferring tubular members between both locations. In operation, crane 141 will transfer the tubular members from storage bay 131 onto the deck for loading onto the shuttle. Once the shuttle is loaded with the tubular members, the shuttle then travels along the catwalk platform towards drill floor 105 and to first activity center 101. The tubular members are then unloaded and utilized for the making up process at the first activity center before they are attached to the top drive assembly and utilized in drilling operations. The tubular members are loaded and transported in a horizontal position with respect to the deck of drillship 100.

In embodiments of the invention, traveling platform 121 is configured to accommodate and deliver risers. As risers are tubular members that are extremely heavy and unwieldy, the shuttle used to receive and transport these risers have to be reinforced and have to be securely mounted onto the catwalk platform to ensure that the risers do not drop as they are being transported.

In embodiments of the invention, as illustrated in FIG. 1, traveling platform 122 is provided between storage bay 132 and second activity center 102 while traveling platform 123 is provided between storage bay 133 and third activity center 103. Traveling platform 122 comprises a shuttle for receiving tubular members and also includes a catwalk platform that runs between storage bay 132 and second activity center 102. Similarly, traveling platform 123 comprises a shuttle for receiving tubular members and also includes a catwalk platform that runs between storage bay 133 and third activity center 103. The shuttle travels along these catwalk platforms transferring tubular members between their respective locations. In operation, cranes 142, 143 will transfer the tubular members from storage bay 132,133 respectively onto the deck for loading onto the respective shuttles. Once these shuttles are loaded with the tubular members, these shuttles then travel along the respective catwalk platforms towards drill floor 105 and to their respective activity centers. Similarly, these tubular members are loaded and transported in a horizontal position with respect to the deck of drillship 100.

In embodiments of the invention, crane 142 operating on the aft end will transfer the drill pipes from pipe storage 132 to the pipe shuttle for subsequent transportation to the auxiliary well at second activity center 102. In embodiments of the invention, crane 143 operating on the forward end will transfer drill pipes or casings from pipe storage 133 to the shuttle. The shuttle will then transport the drill pipes or casings to third activity center 103. Upon receiving the drill pipes or casings from the shuttle, the pipe handling unit adjacent third activity center 103 will lift the drill pipes or casing out of the shuttle. During the process of stand building, these drill pipes or casings will then be vertically mounted on receptacle 109. Alternatively, if stand building processes are not required, the drill pipes and casings are then moved to their respective travelling platforms to be conveyed to their respective storage bays.

For stand building process that involve joint connections, iron roughneck 110 will be used to make up and break out the pipe lengths using a spinning torque wrench. The joint pipes will be conveyed to the second and/or first activity centers for drilling operations. These pipes will then subsequently be run through the main well and/or the auxiliary well at the first and second activity centers respectively. If these joint pipes or casing stands are not yet utilized, these joint pipes or casing stands may be transferred to their respective travelling platforms to be conveyed to their respective storage bays.

The speed of stand-building is limited by the availability of the tubular members that can be supplied to the drill floor at any one time. As each activity center is supplied by its own dedicated traveling platform, the speed of stand-building activities is greatly increased. Further, by having three independent traveling platforms, this enhances the overall performance of stand-building and improves redundancy if one of the traveling platforms is out of service.

Figure 2:
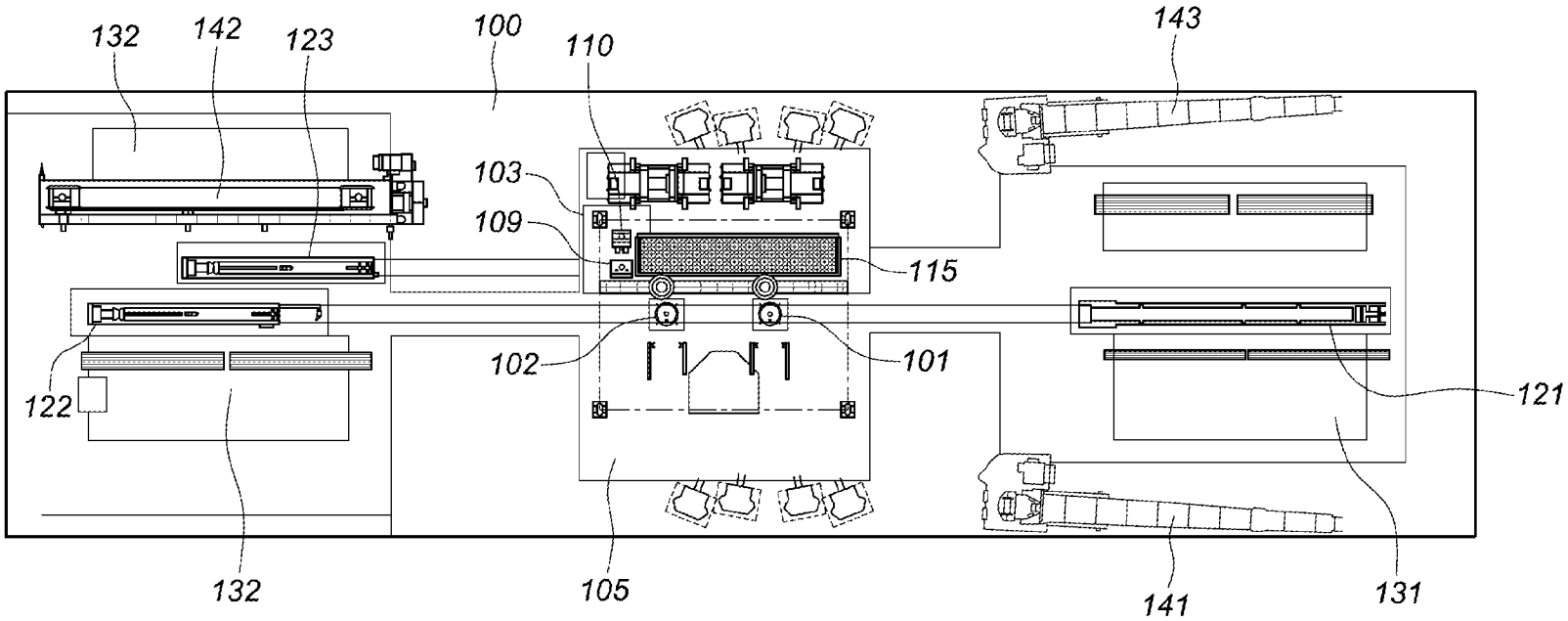
FIG. 2 illustrating a top view of a drillship having a triple activity system whereby the third activity center is provided at the aft side of the drillship in accordance with embodiments of the invention.

FIG. 1 illustrates an embodiment of the invention whereby third activity center 103 and its various components are provided at the forward section of drillship 100 while FIG. 2 illustrates an embodiment of the invention whereby third activity center 103 and its various components are provided at the aft section of drillship 100. In these embodiments of the invention, the positioning of first activity center 101 and second activity center 102 remains unchanged.

Figure 3:
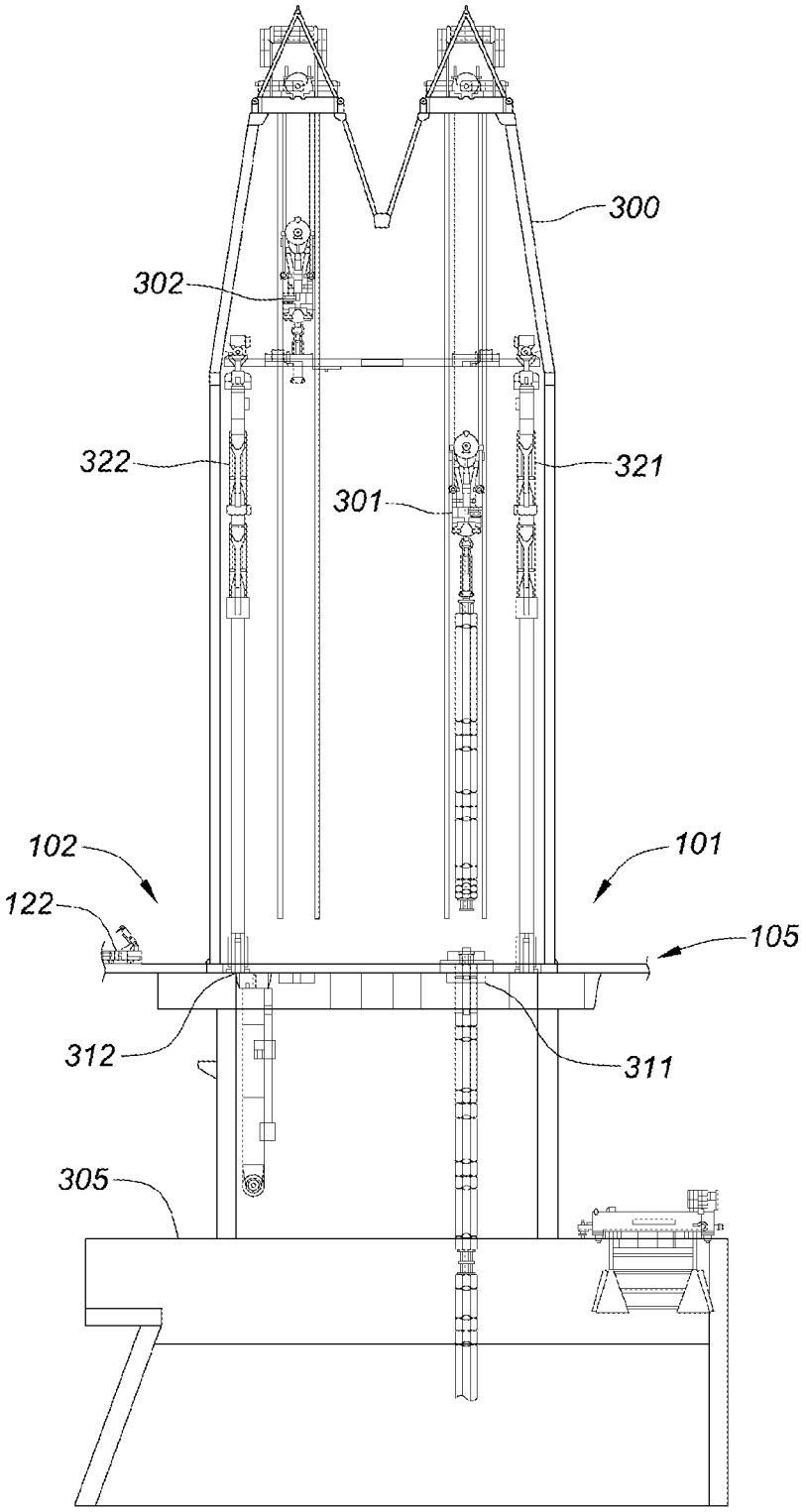
FIG. 3 illustrating an elevated front view of a first activity center and a second activity center in accordance with embodiments of the invention.

FIG. 3 illustrates an embodiment of the invention whereby derrick 300 is positioned over first activity center 101 and second activity center 102. First activity center 101 is provided with top drive assembly 301 that is mounted on the upper section of derrick 300 while second activity center 102 is provided with top drive assembly 302 that is mounted on the upper section of derrick 300 as well. Pipe handling unit 321 is illustrated as being provided adjacent first activity center 101 while pipe handling unit 322 is illustrated as being provided adjacent second activity center 102. Traveling platform 122 is illustrated as being placed adjacent second activity center 102 allowing for the tubular members to be easily and efficiently transferred between the shuttle of the traveling platform and second activity center 102. Main well 311, which is used for drilling operations, is positioned directly above moon pool 305. This allows the tubular members to be easily advanced through main well 311, through moon pool 305 towards the seabed beneath drillship 100. Similarly, auxiliary well 312, which is used for auxiliary drilling operations, is positioned directly above moon pool 305. This allows the tubular members to be easily advanced through auxiliary well 312, through moon pool 305 towards the seabed below drillship 100.

Figure 4:
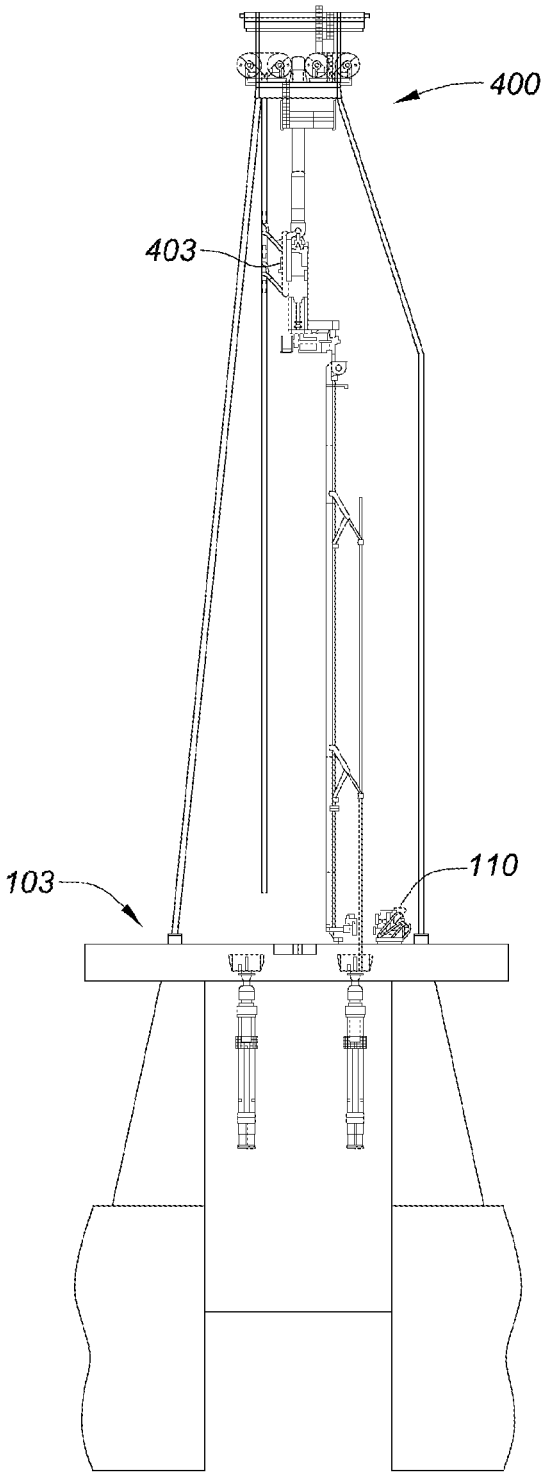
FIG. 4 illustrating an elevated side view of a third activity center in accordance with embodiments of the invention.

FIG. 4 illustrates an embodiment of the invention whereby derrick 400 is positioned over third activity center 103. It is illustrated that top drive assembly 403 is provided on the upper section of derrick 400 to apply rotational forces to the tubular members as the tubular members are being assembled to form drill strings or vertical drill pipes or being disassembled into individual tubular members. Iron roughneck 110 is provided as well at third activity center 103 to assist in the make up or break out of the tubular member assemblies.

Through the introduction of stand-building facilities at third activity center 103, this allows for the faster make up and storage of tubular assemblages thereby shortening the overall process time during drilling and well completion activities. To illustrate this point, a general sequence of events for drilling operations and blowout preventer installation is shown in Table 1 below.

TABLE 1

General Sequence of activities for Drilling and BOP Installation

| | |
|---|---|
| 1 | Standbuilding for 6-5/8" & 5-7/8" DP to Fingerboard |
| 2 | Standbuilding BHA/DC to Fingerboard |
| 3 | Make Up 36" Bit & Trip In & Drill 36" Hole |
| 4 | Trip Out & Breakout to Fingerboard |
| 5 | Make up 30" Casing Tools |
| 6 | Standbuild & Trip in 30" casing & cement |
| 7 | Retrieve 30" Casing Tool & Landing String |
| 8 | Install Permanent Guide Base |
| 9 | Standbuilding for 6-5/8" or 5-7/8" DP to Fingerboard |
| 10 | Make up 26" Bit & Trip In & Drill 26" Hole |
| 11 | Trip Out & Breakout to Fingerboard |
| 12 | Make up 20" Casing Tools |
| 13 | Standbuild & Trip In 20" Casing & Cement |
| 14 | Retrieve 20" Casing Tools & Landing String |
| 15 | Make Up Riser Running Tools |
| 16 | Remove Main Rotary Table Master Bushing |
| 17 | Install Gimbal and Spider on Main Well |
| 18 | Tripping In Riser and BOP |
| 19 | Install Telescopic Joint |
| 20 | Install Diverter with Flex Joint |
| 21 | Remove Gimbal and Spider on Main Well |
| 22 | Replace Main Rotary Table |
| 23 | Standbuilding for 6-5/8" or 5-7/8" DP to Fingerboard |
| 24 | Make up 16" Bit & Trip In & Drill 16" Hole |
| 25 | Trip Out & Breakout to Fingerboard |
| 26 | Make Up 13-3/8" casing tools |
| 27 | Standbuild & Store in Fingerboard Then Trip In 13-3/8" Casing & Cement |
| 28 | Retrieve 13-3/8" casing Tool & Landing String |
| 29 | Standbuilding for 6-5/8" or 5-7/8" DP to Fingerboard |
| 30 | Make up 12-1/4" Bit & Trip In & Drill 12-1/4" Hole |
| 31 | Trip Out & Breakout to Fingerboard |
| 32 | Make Up 9-5/8" casing tools |
| 33 | Standbuild & Store in FB Then Trip In 9-5/8" Casing & Cement |
| 34 | Retrieve 9-5/8" casing Tool & Landing Strip |

Figures 1, 5A:
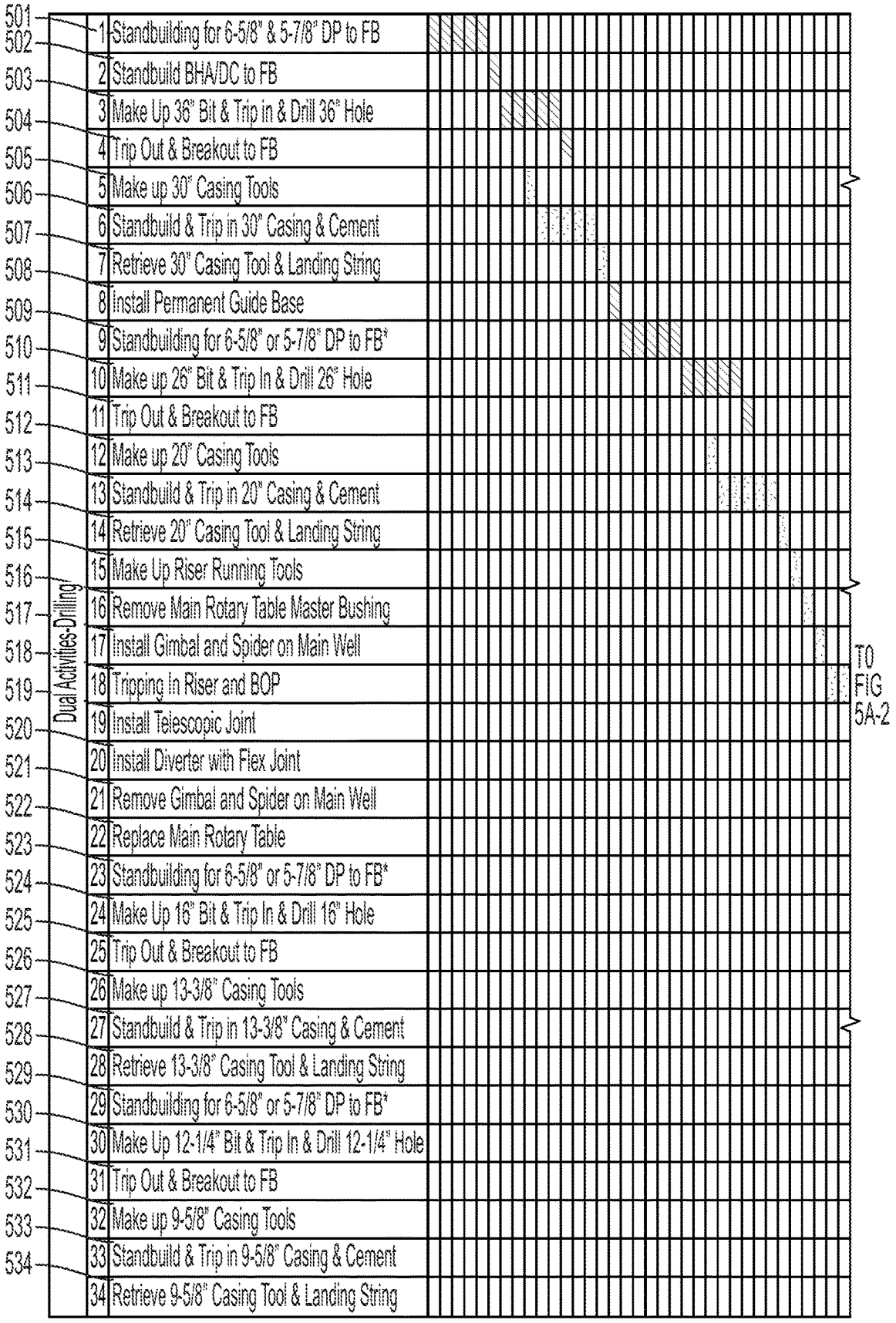
FIG. 5A illustrating a timeline of a conventional drilling operation on a drillship that has two activity centers.
Figures 2, 5A:
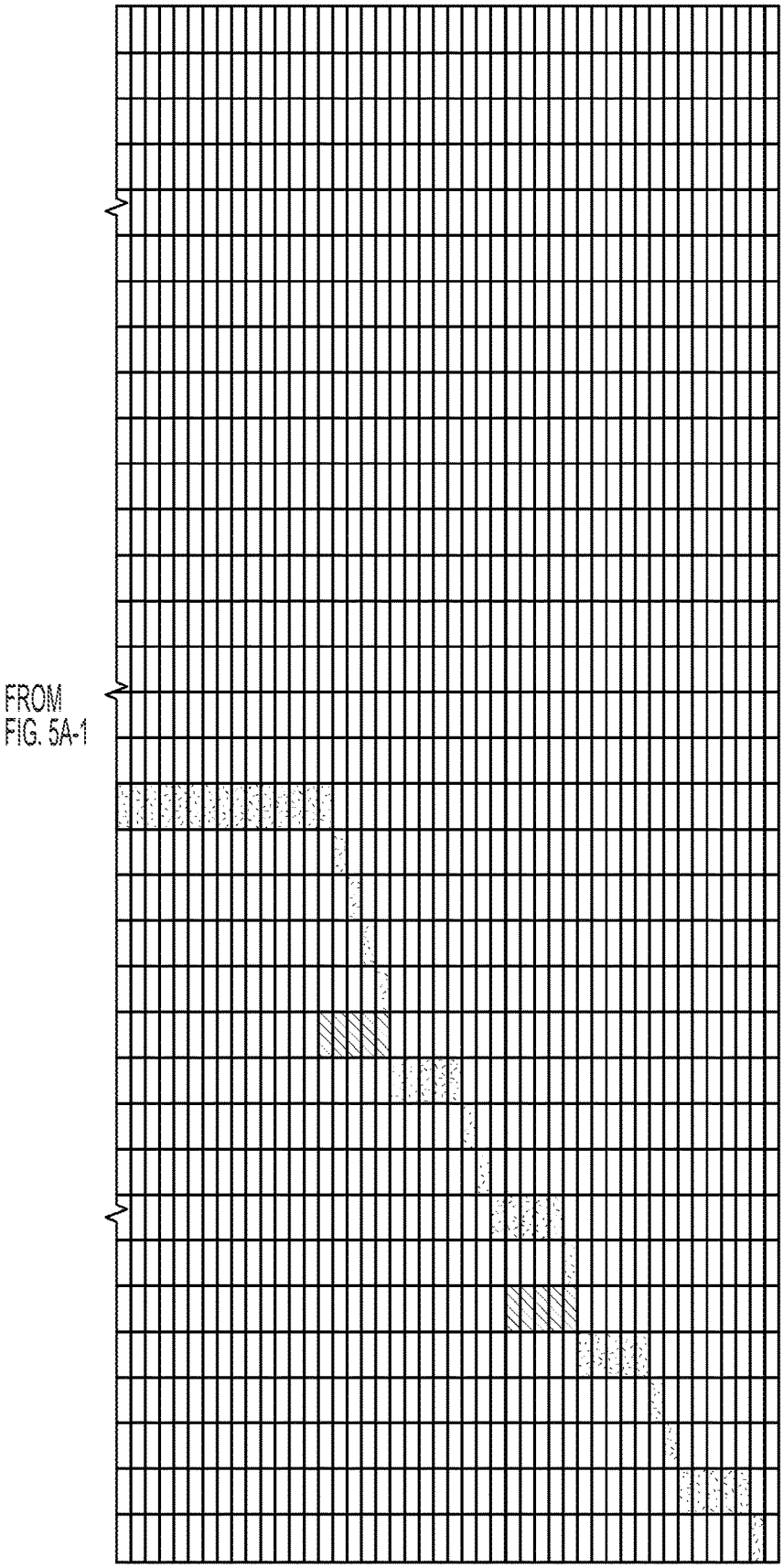
Figures 1, 5B:
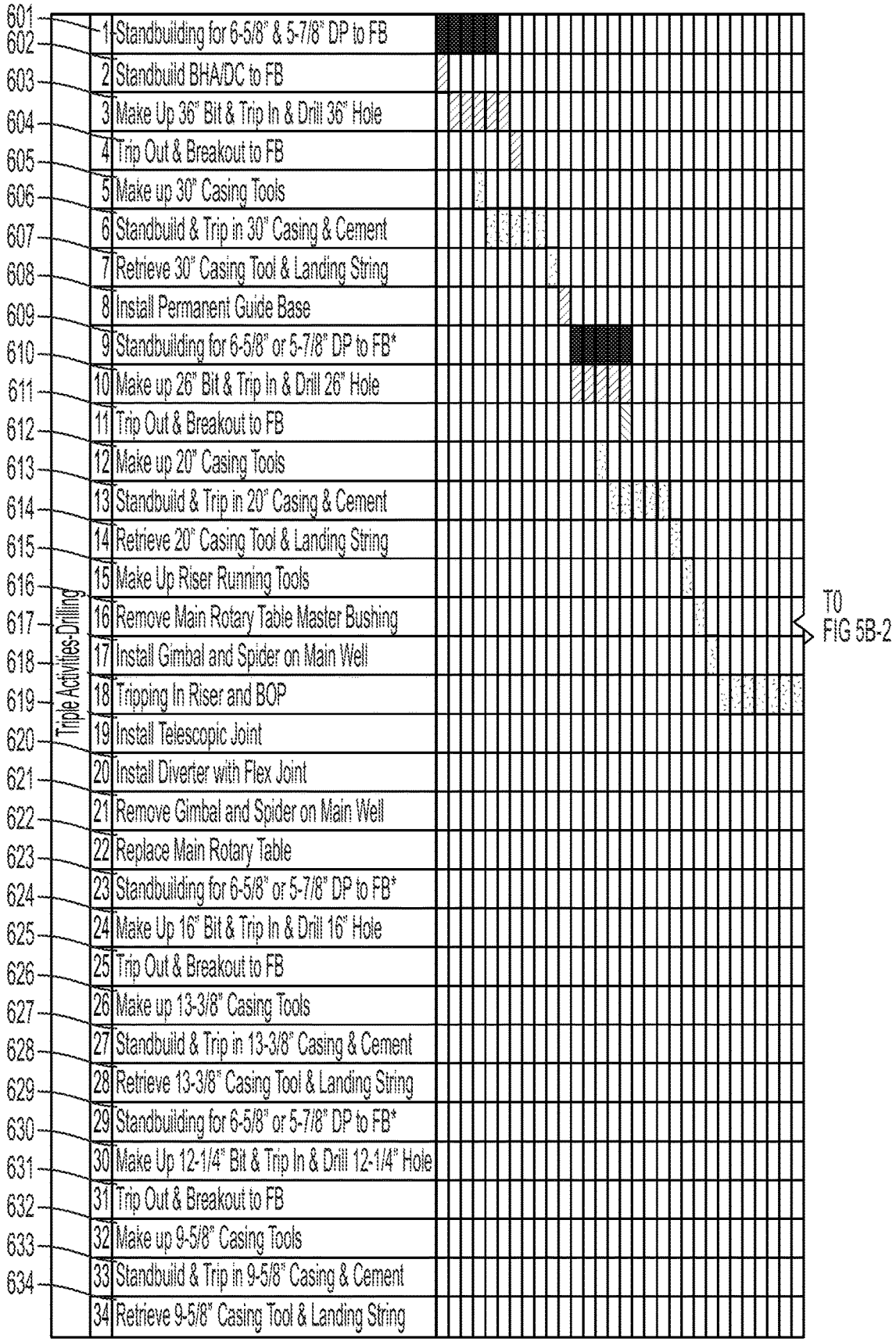
FIG. 5B illustrating a drill ship having two activity centers to perform the drilling operations shown in FIG. 5A.
Figures 2, 5B:
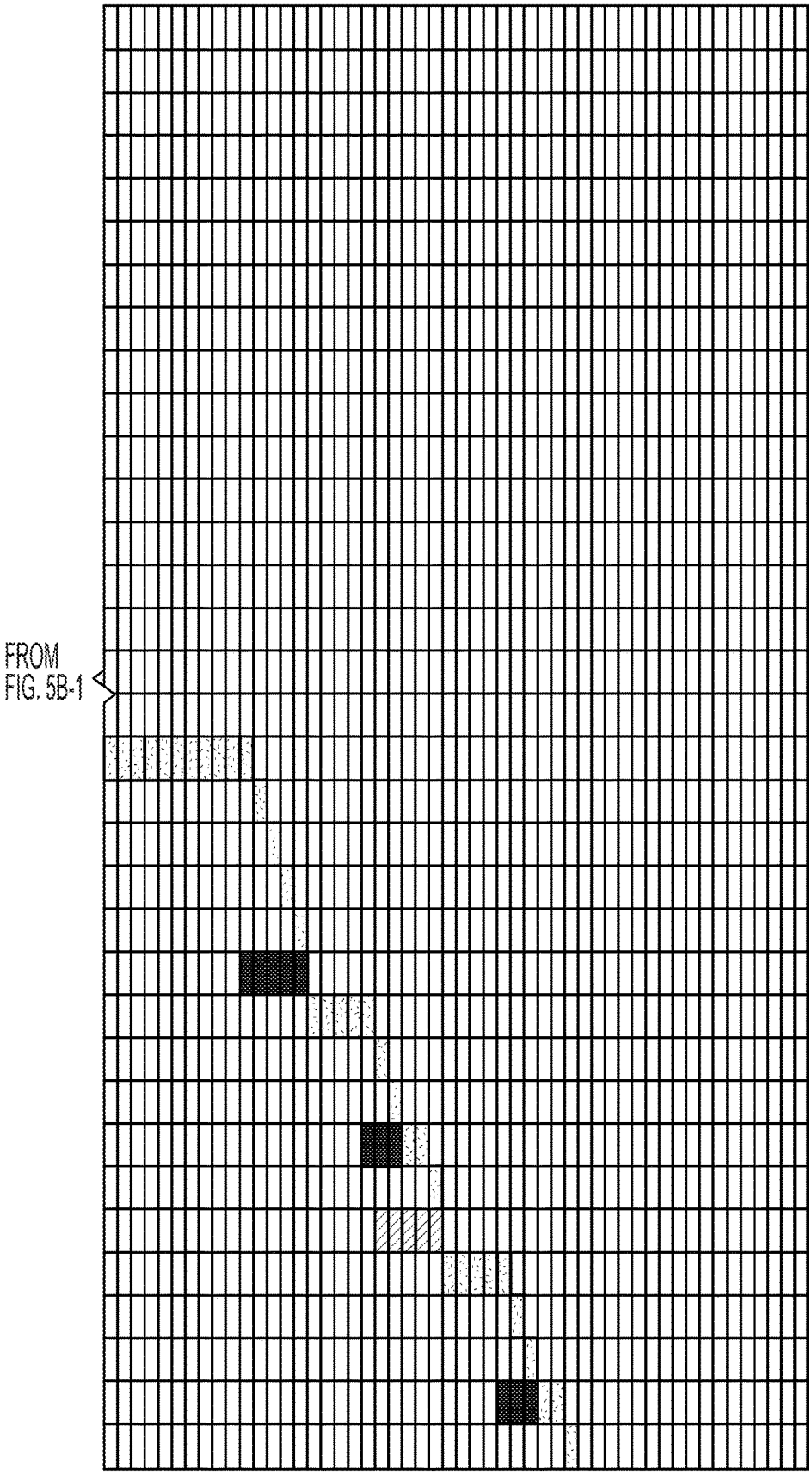

FIG. 5A shows an illustrative graph of timing of activities performed by drillship that utilizes dual activity centers for drilling an offshore well in accordance with conventional drilling operations_as shown in FIG. 5B. The filled in horizontal bars represent the amount of time required to complete a particular activity and the various types of drilling activities are shown along the vertical bar. Each time block represents an indicative completion status of an activity from the point of execution and its progress relative to another parallel running activity.

At steps 501, 509, 523, 527 and 529, drill pipes or casings are retrieved from the pipe storage areas using cranes 550,551. The retrieved drill pipes are then placed onto the catwalk shuttles 555 and subsequently transferred to the drill floor 560. Each individual drill pipe is then joined with other drill pipes to form longer drill strings or drill stands using the iron roughneck and mouse hole. After the required number of drill pipes has been attached to each other up to a required length, each drill string or stand will then be taken by a pipe-handling unit and stored in the fingerboard rack. The stand-building activities at steps 501, 509, 523 and 529 take place at the activity center 561 with the auxiliary well while the activity at step 527 takes place at the activity center 562 with the main well. This means that when stand-building activities are taking place, the auxiliary well may not be used for auxiliary drilling operations.

At step 502, the bottom-hole assembly and drill collars are built up at the activity center 562 with the auxiliary well. The bottom-hole assembly may include components such as drill collars, stabilizers, reamers, shocks and hole-openers. These components are retrieved from the pipe storage areas using cranes. The retrieved components are then placed onto the catwalk shuttles and subsequently transferred to the drill floor. Each component of the bottom-hole assembly is then assembled to form the required assembly using the iron roughneck and mouse hole. After the bottom-hole assembly has been formed and attached, the bottom-hole assembly will then be taken by a pipe-handling unit and stored in the relevant storage area. The assembly of the bottom-hole assembly will usually take place at the activity center 561_with the auxiliary well.

At step 503, the drill string with the 36 inch drill bit is made up and run through a rotary table of a selected well center. This occurs at the activity center 561 with the auxiliary well. A 36 inch top-hole or bore hole will then be drilled through at the seabed via the rotary force transmitted from a top drive assembly located in the derrick. This will typically be done through the auxiliary well. In other drill ship configurations, water jet in hole may be used.

At step 504, after the bore hole has been created, the drilling string and the bottom-hole assembly attached to the end of the drill string will be hoisted back up to the drill floor via the activity center 561_with the auxiliary well. The iron roughneck is then utilized to break up the tubular drill string. The broken up drill pipes are then stored at the fingerboard rack in the storage area.

At steps 505, 512, 515, 526 and 532 the setup will be fitted with casing handling tools such as a pickup elevator and tongs, in preparation for the running of the casings. Similarly, the setup may also be fitted with riser handling tools such as a pickup elevator and tongs in preparation of the running of the risers. These activities all take place at the activity center_562 with the main well.

At steps 506, 513, 527 and 533, the casing string is made up in a similar manner to the drill pipes and run into the wellbore. After the conductor pipe and intermediate casing are attached together, cement slurry may then be circulated into the annulus of the casing string and left to set. These activities all take place at the activity center 562 with the main well.

At steps 507, 514, 528 and 534, the casing tools are then retrieved back to the drill floor after the casing has been lowered to the seabed. All these activities take place at the activity center 562 with the main well.

At step 508, the permanent guide base is then lowered and secured to the casing conductor. This takes place in the activity center 561 with the auxiliary well.

At steps 510, 524 and 530, the drill string having the drill bit with the required diameter is made up and run through a selected well center's rotary table. A hole will then be drilled through at the seabed via the rotary force transmitted from a top drive assembly located in the derrick. The activity at step 510 takes place at the activity center 561 with the auxiliary well while the activities at steps 524 and 530 takes places at the activity center 562 with the main well.

At steps 511, 525 and 531, the drill string is then retrieved back to the drill floor. The iron roughneck is utilized to break up the tubular string and the pipe-handler stores then stores the broken up drill pipers and/or stands back into the fingerboard rack at the storage area. The activity at step 511 takes place at the activity center 561 with the auxiliary well while the activities at steps 525 and 531 takes places at the activity center 562 with the main well.

At step 516, the master bushing of the rotary table is taken out to accommodate the running of the riser through the well center. At step 517, a spider and a gimbal is then installed over the rotary table's receptacle. The spider is an apparatus that is used to support the riser while it is being made up or broken. The gimbal sits in between the spider and rotary table, functioning as a shock absorber and compensating for any offset. These activities all take place at the activity center 562 with the main well.

At step 518, the riser string is connected up, attached to the blowout preventer (BOP) and is lowered to the seabed for mounting onto a permanent guide base. At step 519, a telescopic joint is transported to the drill floor and attached to an upper end of a riser. A diverter will then be attached to the end of the telescopic joint at step 520 and at step 521, after the riser string has been connected and held up by the diverter, the spider and gimbal are then removed. The rotary table is then subsequently reinstated at step 522. These activities all take place at the activity center 562 with the main well.

Figure 6A:
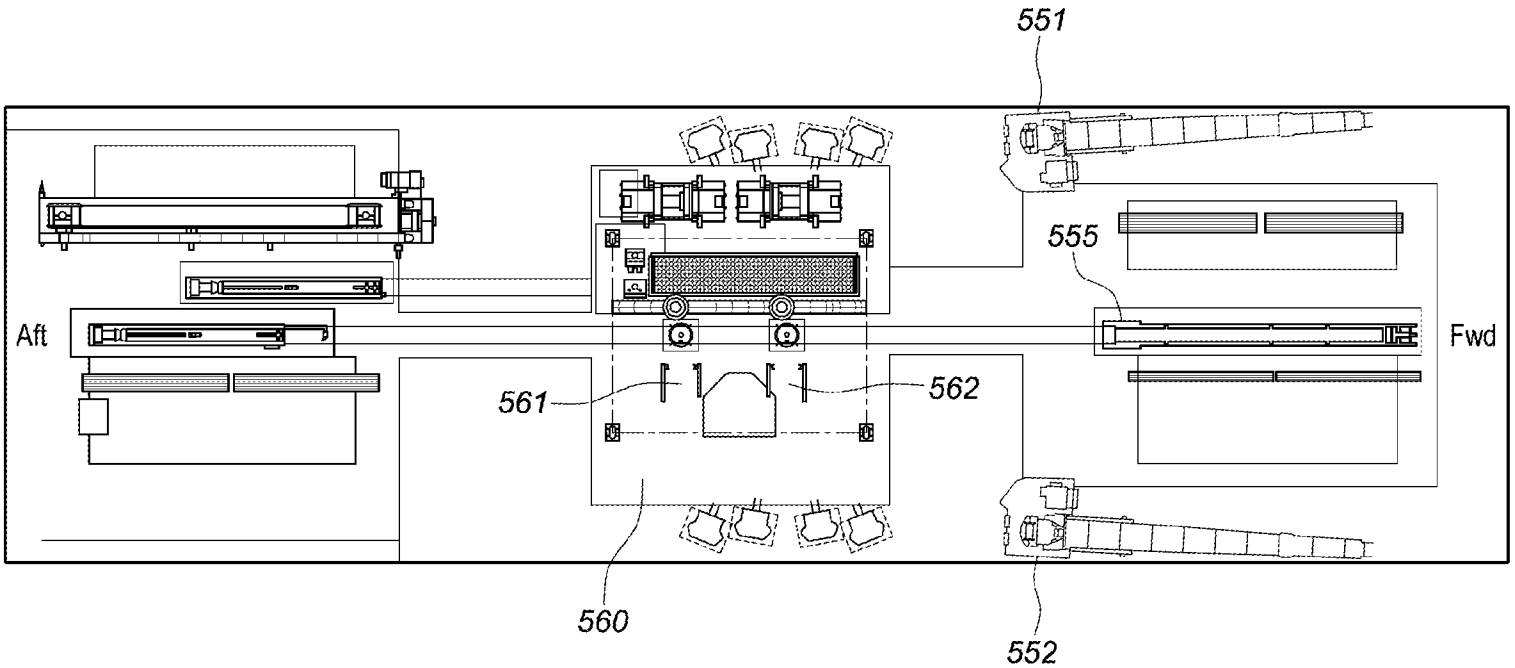
FIG. 6A illustrating a timeline of a conventional drilling operation on a drillship that has a triple activity system in accordance with embodiments of the invention.
Figure 6B:
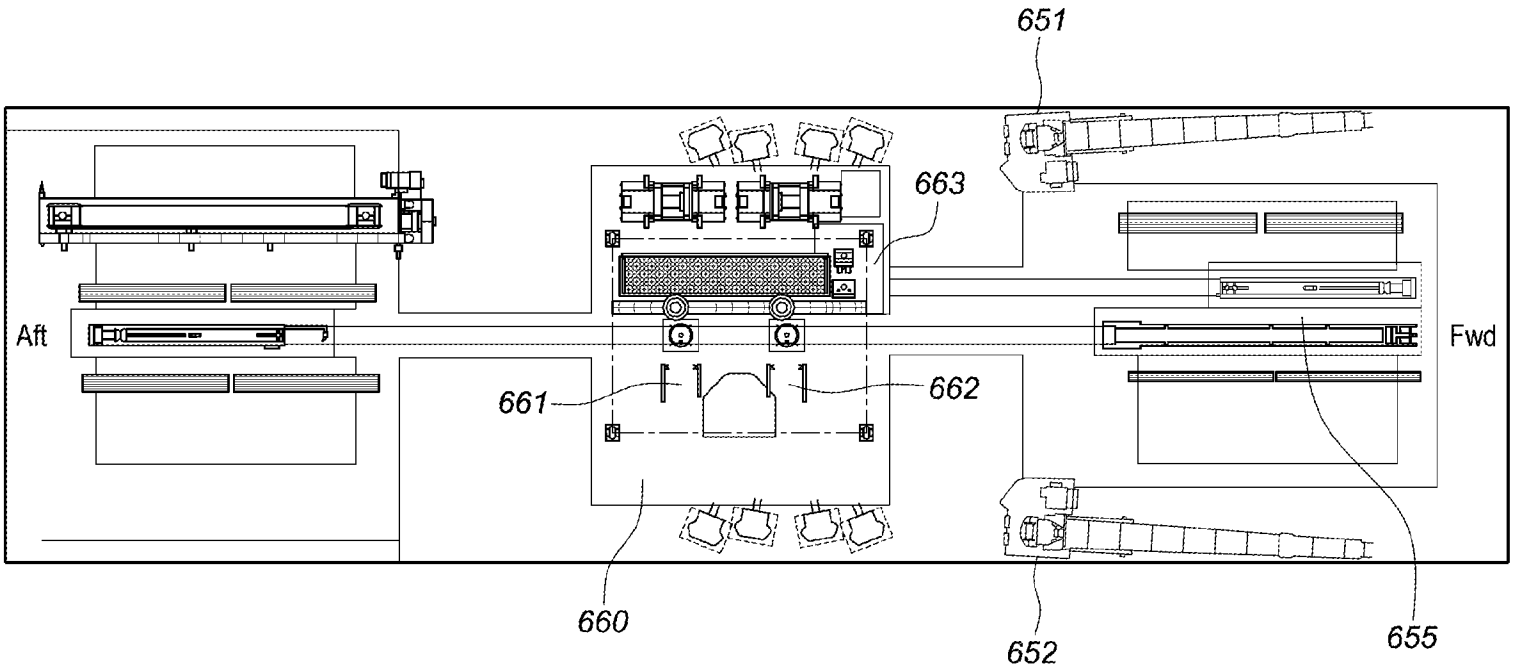
FIG. 6B illustrating a drillship having three activity centers to perform the drilling operations shown in FIG. 6A.

FIG. 6A shows an illustrative graph of timing of activities performed by drillship that utilizes an embodiment of this invention for drilling an offshore well in accordance with conventional drilling operations and FIG. 6B shows the layout of a triple activity system in accordance with an embodiment of the invention. Similarly, the filled in horizontal bars represent the amount of time required to complete a particular activity and the drilling activities are shown along the vertical bar. Each time block represents an indicative completion status of an activity from the point of execution and its progress relative to another parallel running activity.

At steps 601, 609, 623, 627 and 629, drill pipes are retrieved from the pipe storage areas using cranes 650.651. The retrieved drill pipes are then placed onto the catwalk shuttles 655 and subsequently transferred to the drill floor 660. Each individual drill pipe is then joined with other drill pipes to form longer drill strings or drill stands using the iron roughneck and mouse hole. After the required number of drill pipes has been attached to each other up to a required length, each drill string or stand will then be taken by a pipe-handling unit and stored in the fingerboard rack. The stand-building activities at steps 601, 609, 623 and 627 take place at the third activity center 663 whereby the third activity center 663 is provided with an iron roughneck, a receptacle for receiving tubular such as an offline mouse hole, and a pipe handling unit for transferring the completed tubular assemblies to an adjacent storage area. This means that when stand-building activities are taking place, the auxiliary well may be utilized for other types of auxiliary drilling operations. The activity at step 629 takes place at the second activity center 661 with the auxiliary well.

At step 602, the bottom-hole assembly and drill collars are built up. The bottom-hole assembly may include components such as drill collars, stabilizers, reamers, shocks and hole-openers. These components are retrieved from the pipe storage areas using cranes. The retrieved components are then placed onto the catwalk shuttles and subsequently transferred to the drill floor. Each component of the bottom-hole assembly is then assembled to form the required assembly using the iron roughneck and mouse hole. After the bottom-hole assembly has been formed and attached, the bottom-hole assembly will then be taken by a pipe-handling unit and stored in the relevant storage area. The assembly of the bottom-hole assembly will take place at the activity center 661 with the auxiliary well.

At step 603, the drill string with the 36 inch drill bit is made up and run through a rotary table of a selected well center. This activity takes place at the second activity center 662 with the auxiliary well. A 36 inch top-hole or bore hole will then be drilled through at the seabed via the rotary force transmitted from a top drive assembly located in the derrick. This will typically be done through the auxiliary well. In other drill ship configurations, water jet in hole may be used. It can be seen from FIG. 6 that while the activities at step 602 and 603 are being carried out, the stand-building activities at step 601 are still on-going simultaneously at the third activity center 663.

At step 604, after the bore hole has been created, the drilling string and the bottom-hole assembly attached to the end of the drill string will be hoisted back up to the drill floor. The iron roughneck is then utilized to break up the tubular drill string. The broken up drill pipes are then stored at the fingerboard rack in the storage area. This occurs at the second activity center 661.

At steps 605, 612, 615, 626 and 632, the setup will be fitted with casing handling tools such as a pickup elevator and tongs, in preparation for the running of the casings. Similarly, the setup may also be fitted with riser handling tools such as a pickup elevator and tongs in preparation of the running of the risers. All these activities takes place at the first activity center 662 with the main well.

At steps 606, 613, 627 and 633, the casing string is made up in a similar manner to the drill pipes and run into the wellbore. After the conductor pipe and intermediate casing are attached together, cement slurry may then be circulated into the annulus of the casing string and left to set. The making up of the casing string in steps 606 and 613 takes place at the first activity center with the main well while the making up of the casing string in steps 627 and 633 takes place at the third activity center 663.

At steps 607, 614, 628 and 634, the casing tools are then retrieved back to the drill floor after the casing has been lowered to the seabed. All these activities take place at the first activity center 662 with the main well.

At step 608, the permanent guide base is then lowered and secured to the casing conductor. This activity takes place at the second activity center 661 with the auxiliary well.

At steps 610, 624 and 630, the drill string having the drill bit with the required diameter is made up and run through a selected well center's rotary table. A hole will then be drilled through at the seabed via the rotary force transmitted from a top drive assembly located in the derrick. The activity at step 610 takes place at the second activity center 661 with the auxiliary well. The activities at steps 624 and 630 take place at the first activity center 662 with the main well.

At steps 611, 625 and 631, the drill string is then retrieved back to the drill floor. The iron roughneck is utilized to break up the tubular string and the pipe-handler stores then stores the broken up drill pipers and/or stands back into the fingerboard rack at the storage area. The activity at step 611 takes place at the second activity center 661 and the activities at steps 625 and 631 takes place at the first activity center 662 with the main well.

At step 616, the master bushing of the rotary table is taken out to accommodate the running of the riser through the well center. At step 617, a spider and a gimbal is then installed over the rotary table's receptacle. The spider is an apparatus that is used to support the riser while it is being made up or broken. The gimbal sits in between the spider and rotary table, functioning as a shock absorber and compensating for any offset. These activities all take place at the first activity center 662 with the main well.

At step 618, the riser string is connected up, attached to the blowout preventer (BOP) and is lowered to the seabed for mounting onto a permanent guide base. At step 619, a telescopic joint is transported to the drill floor and attached to an upper end of a riser. A diverter will then be attached to the end of the telescopic joint at step 620 and at step 621, after the riser string has been connected and held up by the diverter, the spider and gimbal are then removed. The rotary table is then subsequently reinstated at step 622. These activities all take place at the first activity center 663 with the main well.

By comparing the the timing of activities shown_in FIG. 5A with the timings shown in FIG. 6A, it is shown that a drill ship or drill rig employing an embodiment of the invention is about 20% more efficient as compared to a drill ship that utilizes conventional dual activity drill centers. This is because there are less non-productive time periods due to the availability of drill pipe and casings during critical drilling periods such as during the making up of the drill bit and the tripping riser. One skilled in the art will note that the chain of events, sequences and tubular dimensions listed in FIGS. 5A and 6A may vary from one drilling operator to the next and is to be interpreted as a general mode of operation.

Further, through the introduction of a third catwalk machine with supporting equipment, this improves drilling efficiency and reduces the lead time. This is due to the increase in supply rate and building up of tubular assemblies on the setback area or storage area. The increase in the readiness of the drill pipes and casings to be run into the wells results in cost savings when the reduction of setup time and expenditure on vessel day rates are taken into account. The added feature also ensures that equipment redundancy for casing and drill pipe assembly are minimized.

The above is a description of embodiments of a system and process in accordance with the present invention as set forth in the following claims. It is envisioned that others may and will design alternatives that fall within the scope of the following claims.

The invention claimed is:

1. A triple activity system provided at a drill floor on a drillship for conducting drilling operations on a seabed beneath the drillship comprising:

a first activity center for performing drilling operations at a first position on the drill floor;

a second activity center for concurrently performing drilling operations at a second position on the drill floor;

a third activity centre at a third position on the drill floor for performing auxiliary drilling;

a storage area adjacent the third activity center on the drill floor for receiving and storing tubular drilling equipment from the third activity center;

a first delivery assembly positioned adjacent the storage area, the first activity center, the second activity center, and the third activity center for transferring a piece of tubular equipment between the storage area and at least one of the first activity center, the second activity center or the third activity center;

a second delivery assembly positioned adjacent the first activity center and the second activity center for transferring one or more pieces of tubular equipment between the first activity center and the second activity center to facilitate concurrent drilling operations in the first activity center and second activity center;

a first traveling platform provided between the first activity center and a first tubular member storage bay, the first traveling platform configured to receive a first set of tubular equipment from the first tubular member storage bay and configured to transfer the first set of tubular equipment to the first activity center, wherein the first traveling platform including a first catwalk that extends between the first activity center and the first tubular member storage bay and a first shuttle that travels along the first catwalk;

a second traveling platform provided between the second activity center and a second tubular member storage bay, the second traveling platform configured to receive a second set of tubular equipment from the second tubular member storage bay and configured to transfer the second set of tubular equipment to the second activity center, wherein the second traveling platform including a second catwalk that extends between the second activity center and the second tubular member storage bay and a second shuttle that travels along the second catwalk;

a third traveling platform provided between the third activity center and a third tubular member storage bay, the third traveling platform configured to receive tubular equipment from the third tubular member storage bay and configured to transfer the received tubular equipment to the third activity center, wherein the third traveling platform including a third catwalk that extends between the third activity center and the third tubular member storage bay and a third shuttle that travels along the third catwalk; and wherein the first traveling platform, the second traveling platform, and the third travelling platform operate independently from one another.

2. The triple activity system of claim 1 wherein the first delivery assembly comprises:

a first pipe handling unit configured to transfer the piece of the tubular equipment between a fingerboard rack in the storage area, and one of a first top drive assembly in the first activity center and a second top drive assembly in the second activity center.

3. The triple activity system of claim 2 wherein the second delivery assembly comprises:

a second pipe handling unit configured to transfer the one or more pieces of tubular equipment between the first top drive assembly in the first activity center and the second top drive assembly in the second activity center.

4. The triple activity system of claim 2 wherein a second pipe handling unit is further configured to transfer one or more tubular equipment between the third activity center and the storage area.

5. A method for conducting drilling operations on a seabed beneath the drillship using a triple activity system provided at a drill floor on a drillship, the triple activity system having a first activity center at a first position of the drill floor for performing drilling operations, a second activity center at a second position of the drill floor for performing drilling operations, a third activity center at a third position of the drill floor for performing activities auxiliary to drilling operations, a storage area adjacent the third activity center and a first delivery assembly positioned adjacent the storage area and the second activity center, the method comprising:

carrying out stand building activities at the third activity center;

storing modified tubular equipment from the third activity center at the storage area using the first delivery system;

performing drilling operations using the first activity center;

performing auxiliary drilling operations using the second activity center, the auxiliary drilling operation being performed concurrently to the drilling operations;

transferring a piece tubular equipment between the first activity center and the second activity center using the second delivery system to facilitate concurrently performing the drilling operations and auxiliary drilling operations;

providing a first traveling platform between the first activity center and a first tubular member storage bay, wherein the first traveling platform including a first catwalk that extends between the first activity center and the first tubular member storage bay and a first shuttle that travels along the first catwalk;

receiving a first set of tubular equipment from the first tubular member storage bay using the first traveling platform;

transferring the received the first set of tubular equipment to the first activity center using the first traveling platform;

providing a second traveling platform between the second activity center and a second tubular member storage bay, wherein the second traveling platform including a second catwalk that extends between the second activity center and the second tubular member storage bay and a second shuttle that travels along the second catwalk;

receiving a second set of tubular equipment from the second tubular member storage bay using the second traveling platform;

transferring the second set of tubular equipment to the second activity center using the second traveling platform;

providing a third traveling platform between the third activity center and a third tubular member storage bay, wherein the third traveling platform including a third catwalk that extends between the third activity center and the third tubular member storage bay and a third shuttle that travels along the third catwalk;

receiving a third set of tubular equipment from the third tubular member storage bay using the third traveling platform;

transferring the third set of tubular equipment to the third activity center using the third traveling platform; and wherein the first traveling platform, the second traveling platform, and the third travelling platforms operate independently from one another.

6. The method of claim 5 wherein the storing of the modified tubular equipment from the third activity center comprises:

using a pipe handling unit to transfer the modified tubular equipment between a fingerboard rack in the storage area and a second top drive assembly in the second activity center.

* * * * *